United States Patent [19]

Deforeit

[11] Patent Number: 4,628,790

[45] Date of Patent: Dec. 16, 1986

[54] CIRCUIT FOR AN ELECTRONIC MUSICAL INSTRUMENT

[75] Inventor: Christian J. Deforeit, Semur-en-Auxois, France

[73] Assignee: Matth. Hohner AG, Trossingen, Fed. Rep. of Germany

[21] Appl. No.: 771,971

[22] Filed: Sep. 3, 1985

[30] Foreign Application Priority Data

Sep. 5, 1984 [DE] Fed. Rep. of Germany ..... 3432582

[51] Int. Cl.[4] ..... G10H 1/02; G10H 7/00

[52] U.S. Cl. ..... 84/1.26; 84/1.13; 84/DIG. 10

[58] Field of Search ..... 84/1.13, 1.26, DIG. 10

[56] References Cited

U.S. PATENT DOCUMENTS 4,535,669 8/1985 Kaneko ..... 84/1.26

4,573,389 3/1986 Suzuki ..... 84/1.26

*Primary Examiner*—S. J. Witkowski

[57] ABSTRACT

The realism by which the sound produced by various musical instruments may be electronically simulated is enhanced by the storage of digital data commensurate with scanning values of several periods of a note including the release portion thereof. Command words are also memorized and, in response to the reading of a command word and the state of the input command to the instrument by the player, indicative of whether the note is to be sustained or terminated, the reading of a command word may cause the addressing of the waveform memory to be jumped to the release portion where the read-out will be continued from a scanning value approximately equal to the value read immediately prior to the reading of the command word. The waveform memory may contain a segment of the sustain portion of the note which will be repetitively read so long as the player's input command indicates that the note is to be sustained, the repetition also being in response to memorized command words.

12 Claims, 7 Drawing Figures

CIRCUIT FOR AN ELECTRONIC MUSICAL INSTRUMENT

BACKGROUND OF THE INVENTION (1) Field of the Invention

The present invention relates to enhancing the realism with which the sounds produced by musical instruments are electronically simulated and particularly to a technique wherein the transition from either the attack or sustain portion of a waveform commensurate with a selected sound to the release portion of the waveform may be accomplished smoothly and virtually at any time. More specifically, this invention is directed to a signal generator circuit for use in an electronic musical instrument and especially to an improved circuit for controlling the reading of memorized signals commensurate with the various periods of notes produced by actual musical instruments. Accordingly, the general objects of the present invention are to provide novel and improved methods and apparatus of such character.

(2) Description of the Prior Art

Hereinafter, individual sections or periods of a waveform commensurate with a note played on a musical instrument will be referred to using the conventional terminology, i.e., "attack", "sustain", and "release".

The state-of-the-art prior to the present invention is believed to be exemplified by the disclosure of Published German Patent Application No. 27 15 510 which claims priority from Japanese Application P No. 51 38466. Thus, as disclosed in German Application No. 27 15 510, if a percussion sound is to be simulated, for example a sound as produced by a piano key striking a string, a complete waveform will be memorized including attack, sustain and release sections. Thereafter, if the note is to be electronically simulated, a key on a manual (keyboard) of the electronic musical instrument will be depressed whereupon the memorized waveform is read completely even if the player prematurely releases the key. However, in accordance with the prior technique, should the key be released prior to recreation of the entire memorized note, the waveform will be modified. Specifically, the data read-out of the memory after release of the key will be multiplied by an attenuation function.

If it is necessary for the electronic musical instrument to produce sounds having a sustain portion of the waveform which is of arbitrary duration, as would be required to simulate an organ, it is suggested in German Application No. 27 15 510 that the data commensurate with the sustain portion of the waveform be attenuated, quickly or slowly as required, and this attenuated sustain data be utilized as the release portion of the note.

The prior art technique, as briefly described above, has two major disadvantages. Firstly, the sound produced has a somewhat unnatural quality. Secondly, implementation of the prior technique requires a comparatively large data storage capability.

SUMMARY OF THE INVENTION

The present invention overcomes the above-briefly discussed and other deficiencies and disadvantges of the prior art by providing a novel and improved technique for reading memorized waveform data commensurate with notes to be sounded. The present invention also encompasses apparatus for use in the practice of the aforesaid novel method and particularly to apparatus which enables the transition from either the attack or sustain portion of the waveform to the release portion to be accomplished at any time and without the necessity of completing the read-out of the entire sustain/attack portion of the waveform before the release portion can commence. The present invention permits the memorization of relatively long periods of a natural sound, to thereby improve the simulation of that sound, while allowing the sustain portion of the waveform to be interrupted with negligible delay in order to commence the reading of the data commensurate with the release portion of the waveform upon cessation of a key stroke.

The principal utility of the present invention is believed to be in an electronic musical instrument which includes a clock generator, the clock generator producing a variable clock rate commensurate with the frequencies to be generated. The instrument further includes a waveform memory which is readable at the clock rate. The waveform memory holds scanning values of several periods of a note including its release section, said scanning values being in digital form. The instrument will further comprise a digital-to-analog convertor by means of which the scanning values read out of the waveform memory are converted into analog signals to be processed by succeeding circuits so as to produce audio frequency signals which are delivered to a sound transducer. In accordance with the present invention predetermined memory element addresses of the waveform memory hold command words which control, when read-out, the transmission of a command signal to the clock generator which will cause the read-out of the waveform memory to "skip" to the release portion of the envelope being read whereupon the read-out of the data commensurate with the waveform will continue from substantially the same scanning value as was being read prior to the appearance of the command signal. The analog-to-digital convertor will be disabled during that period of time when a command is being read.

Accordingly, pursuant to the present invention, during the memorization of scanning data, certain memory elements, which are preferably regularly spaced, are set aside for the command words. Upon the reading of these command words, a decoder detects whether in the time period since the reading of the previous command word a "sound off" signal has been detected. In the case of an electronic organ, the detection of a "sound off" signal will be indicative that the key for which data is being read had been released by the player. Under these conditions, i.e., a "sound off" has been detected since the last reading of a command word, the start address for continuing to read data commensurate with the note to be sounded will "jump" to the release section of the stored waveform and the read-out will then continue.

BRIEF DESCRIPTION OF THE DRAWING

The present invention may be better understood and its numerous objects and advantages will become apparent to those skilled in the art by reference to the accompanying drawing wherein.

DESCRIPTION OF THE DISCLOSED EMBODIMENT

Figure 1:
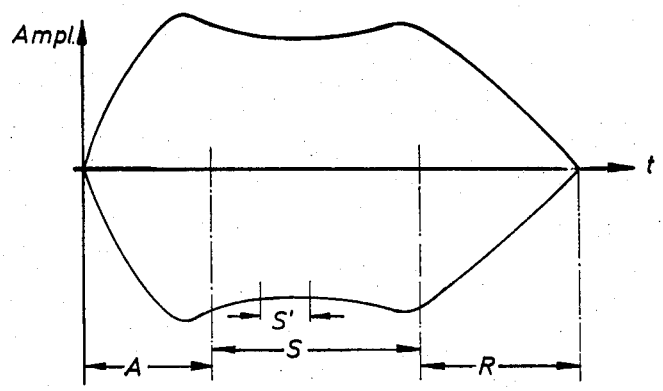
FIG. 1 is a graphical representation of the envelope of an actual sound such as, by way of example, a trumpet note.

Referring now to the drawing, the temporal events comprising a sound generated by means of a musical instrument are shown graphically in the form of sound envelopes. FIG. 1 represents a note which has been "held" by the player such as, for example, would occur during the sounding of a trumpet note. The sound envelope, considered from the viewpoint of its amplitude, has three characteristic sections. These sections are the attack portion A, the sustain portion S and the release portion R.

Figure 2:
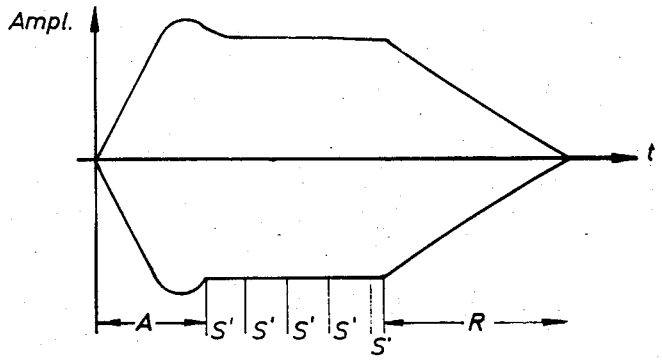
FIG. 2 schematically illustrates how the sound envelope of FIG. 1 is simulated in the practice of the present invention.

FIG. 2 shows the envelope of the electronically simulated "held" note of FIG. 1 in accordance with the practice of the present invention. The attack and release sections, respectively A and R have been memorized in their entirety. However, only a portion, indicated in FIG. 1 as S' of the sustain section has been memorized. This portion S' will be repeated when the "sound on" signal has a duration which exceeds that of the memorized sustain portion S'. It is to be noted that the longer the portion S' the more natural will be the simulated sound. However, because of limitations in memory capacity and access time, it has been found that the duration of portion S' should have a minimum read-out time of about 100 milliseconds and will preferably have a duration of approximately 500 milliseconds.

When a "sound off" signal occurs during a reading of a sustain portion S', it is undesirable to complete the read-out of portion S' before beginning to simulate the release section R of the note. Accordingly, the command word GOREL will be written at predetermined addresses of the waveform memory which holds the amplitude scanning values of the note. When a "sound off" instruction is detected, for example the release of the respective key in the case of an electronic organ, the reading of the sustain portion S' will continue but only until a memory element holding a GOREL command word is addressed. Upon read-out of the GOREL command immediately subsequent to a "sound off" instruction, the waveform memory will be addressed so that the read-out of the scanning data will continue with the release section of the note R. The GOREL commands may be addressed with a temporal spacing of about 10 or, as a maximum, 20 milliseconds depending upon the clock frequency. The minimum spacing of the GOREL command words will be one period of the sound oscillation. Accordingly, certain waveform memories will be suitable for only a limited range of clock frequencies with higher or lower clock frequencies being handled by other memories which are loaded in a commensurate manner. For example, one waveform memory may be provided for each octave to be playable by the instrument.

Figure 3:
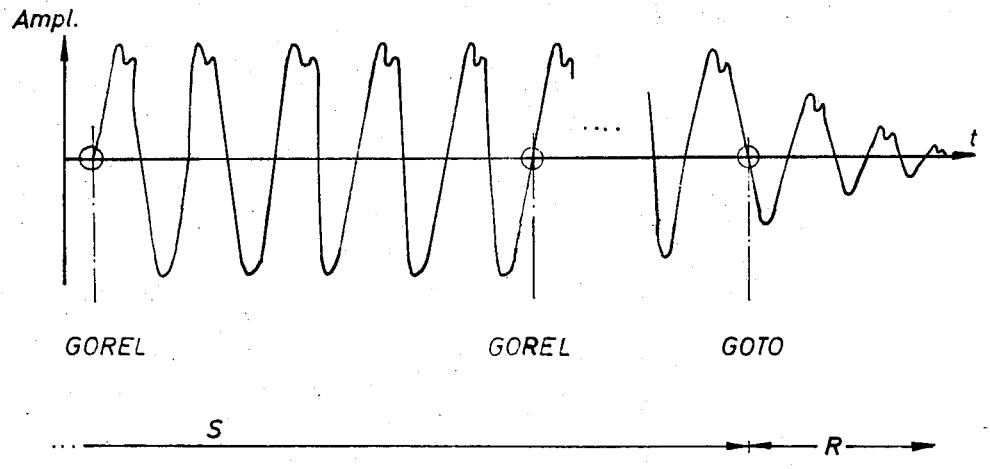
FIG. 3 illustrates, on a time scale considerably expanded when compared to that of FIG. 2, the interspercing of the command words into the scanning values which define the envelope.

As represented in FIG. 3, it is preferable that the addresses at which the GOREL command words are stored be at the zero crossings of the amplitude scanning values which define the envelope. Location of the command words at the zero crossings minimizes noise.

Figure 4:
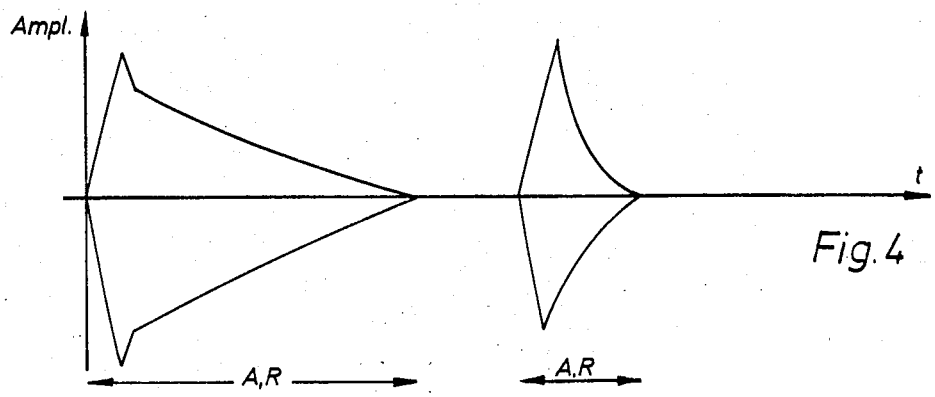
FIG. 4 illustrates the envelopes of percussion sounds, particularly the sound generated by a piano both when the key is held depressed and when the key is struck and immediately released.

FIG. 4 is a showing analogous to that of FIG. 1. However, FIG. 4 depicts percussion sounds such as would be produced by the striking of a key on a piano. Such percussion sounds have an attack section A which is followed immediately by a release section R. The left-hand envelope of FIG. 4 represents the case of a key which remains depressed after it has been struck and, accordingly, there is a steady decrease of the amplitude of the sound produced. The right-hand envelope of FIG. 4 represents a sudden key strike, i.e., the key is quickly depressed and immediately released.

Figure 5:
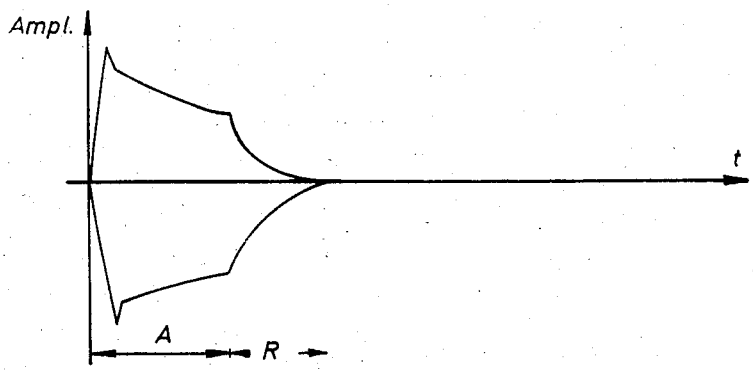
FIG. 5 schematically shows how percussion sounds are reproduced in accordance with the practice of the present invention.

As shown in FIG. 5, both of the envelopes are memorized and are utilized in the reproduction of a percussion sound where a key is released during the "natural" release phase. It is particularly to be noted that in the example of FIG. 5 there is no sustain section of the envelope. The technique illustrated in FIGS. 4 and 5 may, for example, be implemented by use of a first memory for the attack/release envelope values depicted at the left side of FIG. 4 and a second memory for the data commensurate with the immediate release envelope of FIG. 4 right, the two memories having the same addresses for equal envelope amplitudes thus enabling execution of a GOREL command by simply switching the read-out from the first to the second memory at the same address.

Figure 6:
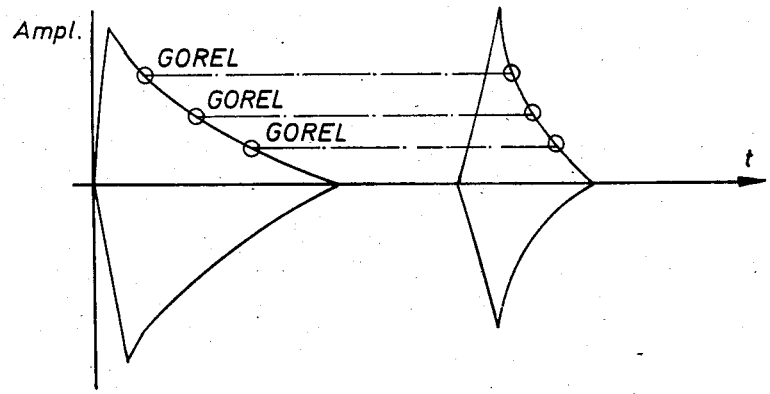
FIG. 6 is a graphical showing similar to that of FIG. 3 depicting the interspercing of the command words in the scanning data.

FIG. 6 shows that, upon detection of a GOREL command, as discussed above the possibility of proceeding immediately to the address of the same amplitude but in the R section of the memory will be presented. This results in an excellent simulation of the natural sounds. The "jump" to the R section will, of course, be performed only if the depressed key has been released prior to detection of the GOREL command.

Figure 7:
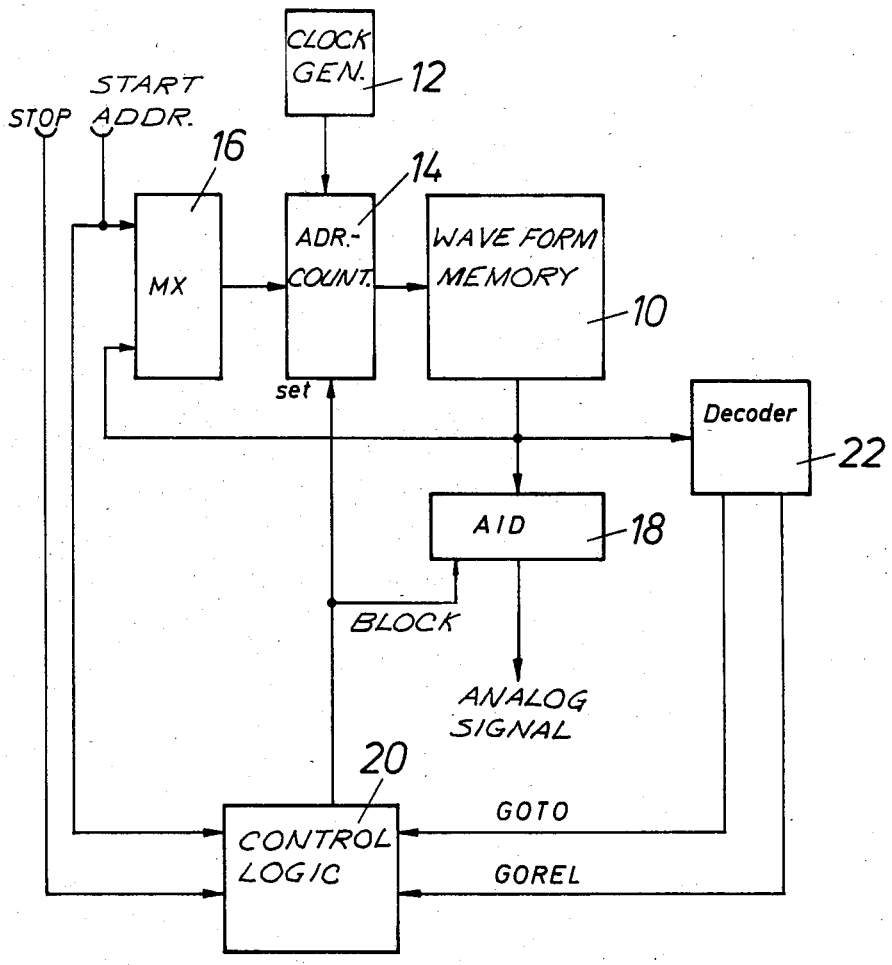
FIG. 7 is a functional block diagram of apparatus in accordance with the present invention.

FIG. 7 is a functional block diagram of apparatus for implementing the present invention. Scanning values of a waveform commensurate with a note to be reproduced are memorized in waveform memories, only one of which is shown at 10. The memorized amplitude scanning data may be in absolute values, differential values or any other digital representation of the amplitude variations. Either ROM or RAM type memories may be used. In a case of a RAM memory, external loading means such as, for example, a microprocessor will be provided. As discussed above, at certain memory addresses, the command word GOREL will be written into memory 10. Additionally, GOTO command words are also memorized.

A significant delay between release of a key and "jumping" from the attack A section (or the sustain S' section) of the waveform memory to the release R section must be avoided. Accordingly, many GOREL commend words are provided. For example, one GOREL command word is preferrably memorized after each fifth sound period. By way of example, the acceptable delay may be at most 20 milliseconds and this means for a 250 Hz sound there will be a GOREL command word after each fifth period. If the reading frequency is doubled, the temporal spacing between two succeeding GOREL commands will be reduced to 10 milliseconds. In order to maintain this 10–20 milliseconds spacing, one waveform memory 10 will be provided for each octave.

The GOTO commands are provided only if the memory 10 contains an S' section. The reading duration of S' will be at least 100 milliseconds. Thus, for the example given above, for a sound frequency of 500 Hz at least fifty periods of a natural sound have to be memorized to form S'. With a frequency of 250 Hz, the S' duration will be doubled to 200 milliseconds.

The reading clock pulses are supplied by a clock generator 12 which is coupled to an address counter 14. Upon depression of a key, the address counter 14 will receive, via multiplexer 16, the start address. Stored data will thereafter be read from memory 10 and delivered to a digital-to-analog convertor 18. The analog signal outputted from convertor 18 will be further processed by filters, amplifiers and the like, as is common practice in electronic musical instruments, and ultimately used to drive a sound transducer. The data read from memory 10 is also inputted to a decoder 22 which detects whether a GOREL or GOTO command word has been read. The following possibilities are presented:

key still depressed: Ignore GOREL.

key still depressed: GOTO will set address counter to the start address of subsection S' (if any).

key released (symbolized by STOP line): Ignore GOTO.

key released: GOREL will set address counter 14 to the "homologue" address of the R section of the memorized sound, i.e. that address where (i) with a preceding S' subsection, the R section begins, or (ii) with a preceding A section (or portion thereof) the same or most similar amplitude value of the R section is memorized.

Control logic 20, which receives signals commensurate with the detection of either a GOREL or GOTO command from decoder 22, will provide a disabling signal to the "BLOCK" input of convertor 18. Accordingly, the memorization of the command words will not result in the addition of "noise" to the output of convertor 18.

The data processing described above is implemented by control logic 20 which may, for example, be a ROM or gate array logic. Control logic 20 provides the signal which sets the address counter 14 to the "HOMOLOGUE" address of the R section of the memorized sound. The control logic may be easily implemented by one skilled in the art based upon the following truth table:

| Start address | GOTO | GOREL | STOP | SET | Remarks |
|---|---|---|---|---|---|
| no | no | no | no | no | normal sound generation |
| yes | no | no | no | yes | input start address into counter 14 |
| no | yes | no | no | yes | input of S' start address into counter 14 |
| no | no | yes | no | no | ignore GOREL |
| no | no | yes | yes | yes | input of R address into counter 14. |

It will be understood that the above-described circuit may be modified in order to produce a polyphonic instrument. In this regard, reference may be had to European Pat. No. 36074 which discloses a circuit for an electronic musical instrument which operates with a variable clock rate.

The circuit of FIG. 7 may be implemented by using commercially available integrated circuits. Thus, for example:

Wave form memory: IC 27256 of the company INTEL

Digital-analog-converter: IC DAC 08 NS or IC DAC 16 PCM of company Burr-Brown

Control logic: Gate array PAL Series MMI of company Monolithic Memories Inc.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In an electronic musical instrument, the instrument including a clock generator producing clock pulses at a variable rate commensurate with the frequencies of sounds to be generated, the instrument further including a waveform memory which is read in response to the clock generator output pulses, the memory storing digitized information commensurate with scanning values of at least two periods of a note including the release portion of the note, the instrument further including a digital-to-analog convertor for converting scanning values read from the memory into analog signals suitable for processing by succeeding circuits to produce audio frequency signals to be transduced into audible sound, the improvement comprising storing first command words at predetermined addresses in the waveform memory, said first command words controlling, when read-out, transmission of a first command signal to the clock generator to set the address from which scanning value information is read from the memory to an address in the release portion of the note having approximately the same scanning value as was read prior to the reading of a first command signal, and means for disabling the digital-to-analog convertor during the read-out of the first command words from the waveform memory.

2. The apparatus of claim 1 wherein successive first command words are separated by at least one period of a waveform.

3. The apparatus of claim 2 wherein the number of stored scanning values between successive first command words is selected so that the spacing between successive first command words will not exceed approximately 20 milliseconds taking into account the output frequency of the clock generator.

4. The apparatus of claim 3 wherein the instrument includes a plurality of waveform memories, each waveform memory being allocated to preselected range of clock generator output frquencies.

5. The apparatus of claim 4 wherein each waveform memory has a storage capacity commensurate with a read-out duration of at least 100 milliseconds.

6. The apparatus of claim 1 wherein the waveform memory stores digitized information commensurate with the scanning values of attack and sustain portions of the note and wherein second command words are memorized, the read-out of a second command word causing transmission of a second command signal to the clock generator so as to set the clock generator to an address corresponding to the first scanning value of the sustain portion of the note, said second command words being stored at memory locations commensurate with the end of the sustain portions of notes whereby the detection of a second command word will cause the re-reading of the sustain portion of the note, the digital-to-analog convertor being disabled during the reading of said second command words.

7. The apparatus of claim 5 wherein the waveform memory stores digitized information commensurate with the scanning values of attack and sustain portions of the note and wherein second command words are memorized, the read-out of a second command word causing transmission of a second command signal to the clock generator so as to set the clock generator to an address corresponding to the first scanning value of the sustain portion of the note, said second command words being stored at memory locations commensurate with the end of the sustain portions of notes whereby the detection of a second command word will cause the re-reading of the sustain portion of the note, the digital-to-analog convertor being disabled during the reading of said second command words.

8. The apparatus of claim 1 wherein the means for disabling the digital-to-analog convertor and re-setting the read-out address comprises control logic, and wherein said apparatus further comprises decoder means responsive to the read-out of a command signal from the waveform memory for providing a control input to the control logic.

9. The apparatus of claim 5 wherein the means for disabling the digital-to-analog convertor and re-setting the read-out address comprises control logic, and wherein said apparatus further comprises decoder means responsive to the read-out of a command signal from the waveform memory for providing a control input to the control logic.

10. The apparatus of claim 7 wherein the means for disabling the digital-to-analog convertor and re-setting the read-out address comprises control logic, and wherein said apparatus further comprises decoder means responsive to the read-out of command words from the waveform memory for providing control inputs to the control logic commensurate with the command word which has been read.

11. A method for the production of an analog signal commensurate with a sound to be produced, the sound being a simulation of a note provided by a musical instrument, the sound having an amplitude envelope including at least an attack portion, a sustain portion and a release portion, said method comprising the steps of:

digitizing and memorizing the attack and release portions of the note;

digitizing and memorizing a section of the sustain portion of the note;

digitizing and memorizing, at preselected intervals within the sustain section of the note, a first command word;

digitizing and memorizing, at the end of the sustain section of the note, a second command word;

reading the memorized attack portion of the note;

reading the memorized values commensurate with the note including the first command words;

proceeding to read at least a part of the release portion of the note upon the reading of a first command word, the reading of the part of the release portion of the note beginning at a amplitude value approximately equal to the last-read amplitude value of the note;

converting the serially read data commensurate with the attack and part of the release portion of the note into an analog signal; and ignoring the command words during the conversion of the read-out data into an analog signal.

12. A method for the production of an analog signal commensurate with a sound to be produced, the sound being a simulation of a note provided by a musical instrument, the sound having an amplitude envelope including at least an attack portion, and a release portion, said method comprising the steps of:

digitizing and memorizing amplitude values commensurate with the attack and release portions of the note;

digitizing and memorizing, at preselected intervals within the note, a first command word;

reading the memorized values commensurate with the note including the first command words;

proceeding to read at least a part of the release portion of the note upon the reading of a first command word, the reading of the part of the release portion of the note beginning at an amplitude value approximately equal to the last-read amplitude value of the note;

converting the serially read data commensurate with the attack and part of the release portion of the note into an analog signal; and ignoring the command words during the conversion of the read-out data into an analog signal.

* * * * *